US005123807A

United States Patent [19]

Nakaoda et al.

[11] Patent Number: 5,123,807

[45] Date of Patent: * Jun. 23, 1992

[54] SYSTEM FOR STACKING VENEER SHEETS CONVEYED FROM TWO DIFFERENT DIRECTIONS

[75] Inventors: Toshinori Nakaoda, Aichi; Teruaki Aoto, Ohbu; Nagara Aoyama, Nagoya; Tsuyoshi Nakamura; Ritsuo Nishimura, both of Ohbu, all of Japan

[73] Assignee: Meinan Machinery Works, Inc., Ohbu, Japan

[ * ] Notice: The portion of the term of this patent subsequent to May 7, 2008 has been disclaimed.

[21] Appl. No.: 644,529

[22] Filed: Jan. 23, 1991

Related U.S. Application Data

[63] Continuation-in-part of Ser. No. 580,631, Sep. 7, 1990, abandoned, which is a continuation of Ser. No. 320,109, Mar. 6, 1989, Pat. No. 5,013,211.

[51] Int. Cl.[5] ..... B65M 9/00

[52] U.S. Cl. ..... 414/789.6; 414/791; 414/794.2; 414/794.4; 271/189

[58] Field of Search ..... 414/789.6, 793.5, 794.1, 414/794.2, 794.3, 794.8, 791, 792.7, 794.4; 271/189, 185, 184

[56] References Cited

U.S. PATENT DOCUMENTS

| | | | |
|---|---|---|---|
| 4,173,275 | 11/1979 | Pfeiffer et al. | 198/421 |
| 4,189,271 | 2/1980 | Hasegawa | 414/35 |
| 4,316,758 | 2/1982 | Suzuki et al. | 156/351 |

FOREIGN PATENT DOCUMENTS

| | | | |
|---|---|---|---|
| 50-111503 | 3/1977 | Japan . | |
| 56-133104 | 10/1981 | Japan . | |
| 62-157753 | 7/1987 | Japan | 414/789.6 |
| 2054527 | 2/1981 | United Kingdom . | |

*Primary Examiner*—Frank E. Werner
*Assistant Examiner*—James Eller
*Attorney, Agent, or Firm*—Lahive & Cockfield

[57] ABSTRACT

A system for stacking veneer sheets conveyed from two different directions includes a lower mechanism for carrying a first veneer sheet to a first position above a stack support and an upper mechanism for carrying a second sheet to a second position above the first position. The first veneer sheet carried to the first position may not be dropped immediately, but waits for the second veneer sheet to be dropped thereon from the second position, and then the first and second veneer sheets may be dropped as one body on the stack support. The lower carry mechanism includes a carry roller and a sheet carrier which may be moved substantially synchronously. However, the sheet carrier is moved through a stopper away from the carry roller when the veneer sheets are to be freed from the support thereof by the sheet carrier.

8 Claims, 12 Drawing Sheets

SYSTEM FOR STACKING VENEER SHEETS CONVEYED FROM TWO DIFFERENT DIRECTIONS

REFERENCE TO RELATED APPLICATION

The present application is a continuation in part of U.S. continuation patent application No. 580,631 filed Sept. 7, 1990, now abandoned, which is a continuation of the U.S. patent application of the same title, Ser. No. 320,109 filed Mar. 6, 1989, which issued as U.S. Pat. No. 5,013,211 on May 7, 1991.

FIELD OF THE INVENTION

This invention relates to a system for stacking veneer sheets conveyed from two different directions to one and the same place.

BACKGROUND OF THE INVENTION

A typical conventional system for introducing sheets from two different directions to predetermined positions of different heights and dropping the sheets therefrom in one and the same place is disclosed in Japanese Utility Model Application No. 61-3246 (published under No. 62-157753) for an invention entitled "System for Supplying Sheets into a Case". The system disclosed therein includes a conveyor located above a case and having upper and lower sheet holders. The lower sheet holder holds one end of a first sheet provided on a left-hand side support and carries the sheet to a first predetermined position above the case, while the upper sheet holder holds one end of a second sheet provided on a right-hand side support and carries the sheet to a second predetermined position above the first predetermined position. Then, the two sheet holders release the sheets to drop the sheets into the case. Since the first sheet is nearer to the bottom of the case, first the first sheet, and then the second sheet, come into the case. This operation may be reiterated a number of times to stack a number of sheets from the opposed directions in one and the same place.

Since the first sheet is nearer to the bottom of the case, the first sheet may drop relatively exactly on a predetermined position in the case. However, since the second sheet has a longer distance to the case than the first sheet, it is quite possible that the second sheet may not drop straight on the first sheet in the case, but may meet sufficient air resistance to deviate the second sheet from the straight path in a horizontal direction as it drops, with the result that the second sheet only overlaps the first sheet instead of overlying the first sheet exactly. The portion of the second sheet which does not overlie the first sheet must be cut out. It is a waste of the material and results in a smaller yield. If such a portion is not cut out, such a portion may go against parts of a conveyor which conveys the stacked sheets to a subsequent stage, thus creating trouble.

SUMMARY OF THE INVENTION

It is an object of the invention to provide a system for stacking veneer sheets conveyed from two different directions to one and the same place.

Another object of the invention is to provide a system for stacking veneer sheets conveyed from two different directions to two different levels to one and the same place whereby both the veneer sheets conveyed to the higher level and to the lower level may be dropped straight on the same position.

Still another object of the invention is to provide a system for stacking veneer sheets conveyed from two different directions to two different levels to one and the same place whereby after the conveyance of a first veneer sheet to a first position above a stack support and of a second veneer sheet to a second position above the first position, first the second veneer sheet starts to be dropped and then the first veneer sheet is dropped on the stack support.

A further object of the invention is to provide a system for stacking veneer sheets conveyed from two different directions to two different levels to one and the same place whereby a first veneer sheet conveyed from one direction to an intermediate position above a stack support is not dropped immediately on the support, but waits for a second veneer sheet conveyed from another direction to a position above the intermediate position to be dropped thereon, and then the first and second veneer sheets are dropped as one body on the support.

Other objects and advantages of the invention will become apparent upon reading a detailed description of a preferred embodiment of the invention.

According to the invention, a core veneer sheet conveyed from one direction is transferred onto lower carry means without stopping, and is carried thereby to an intermediate position above a stack support. On the other hand, two outer veneer sheets are conveyed in layers from an opposed direction, and are transferred to a position above the intermediate position by upper carry means. Then, the outer veneer sheets may be dropped on the core veneer sheet carried to the intermediate position, and thereafter the core and outer veneer sheets may be dropped as one body on the stack support.

DETAILED DESCRIPTION OF A PREFERRED EMBODIMENT

With reference to the drawings, a detailed description will now be given of one preferred embodiment of the invention, that is, a system for stacking veneer sheets conveyed from opposite directions to one and the same place for the purpose of producing a three-veneer plywood.

Figure 1:
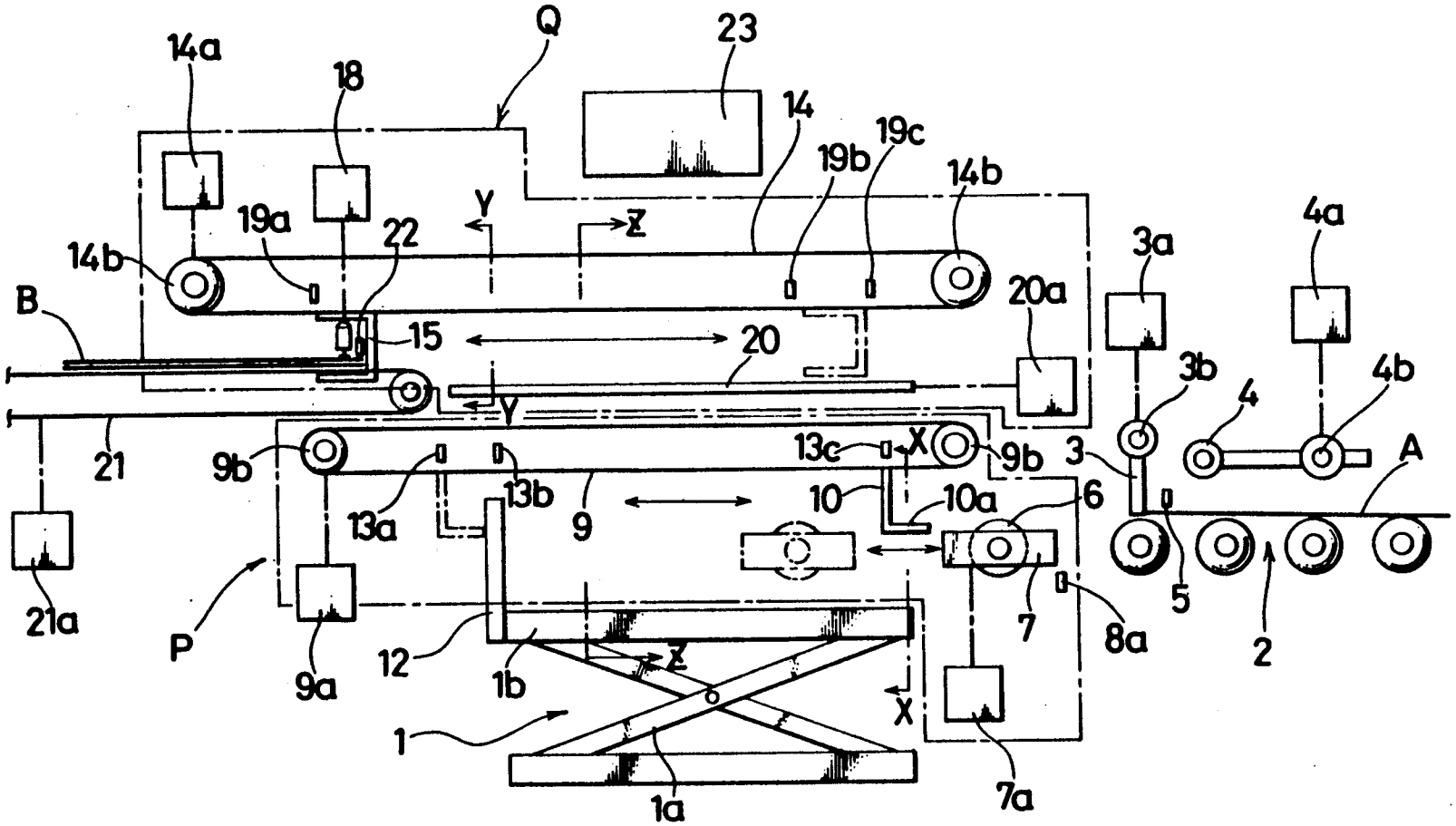
FIG. 1 is a front view of a stacking system according to the invention.
Figure 2:
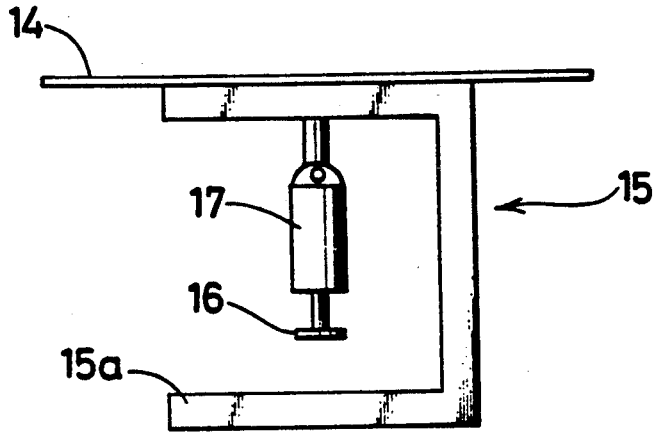
FIG. 2 is an enlarged view of a sheet carrier used for an upper carry mechanism of the system of FIG. 1.

Referring to FIG. 1, reference numeral 1 designates a support on which to stack veneer sheets. The stack support 1 includes vertically-extensible X-shaped legs 1a. As in the prior art, the stack support 1 is provided with a means for determining when the veneer sheets stacked thereon have reached a certain height (not shown), and is adapted to lower when so determined.

Reference numeral 2 designates a roller conveyor including plural rollers. A core veneer sheet A is conveyed toward the support 1 by the roller conveyor 2. An adhesive material is applied to both the upper and lower surfaces of the veneer sheet A before the veneer sheet A is conveyed by the roller conveyor 2. When the power of the system hereof is turned on, the conveyor 2 starts to be operated, i.e., the rollers thereof start to be rotated counterclockwise, and as long as the power is on, the conveyor 2 is in operation. A press roller 4 is located above the roller conveyor 2. The press roller 4 is mounted on an arm which is fixed to a shaft 4b at one end thereof. The shaft 4b is coupled to a piston-type cylinder 4a. When the cylinder 4a is operated, the shaft 4b is rotated counterclockwise or clockwise. When the shaft 4b is rotated counterclockwise, the press roller 4 is lowered to a position where the roller 4 contacts the veneer sheet A on the conveyor 2. When the shaft 4b is rotated clockwise, the roller 4 is lifted to a horizontal, non-contact position of FIG. 1. A block 3 is located above the leftmost roller of the conveyor 2. The block 3 has an upper end fixed to a shaft 3b which is coupled to a piston-type cylinder 3a. When the cylinder 3a is operated, the shaft 3b is rotated counterclockwise or clockwise. When the shaft 3b is rotated counterclockwise, the block 3 is turned downward to a vertical position of FIG. 1 where the block 3 stops the movement of the sheet A toward the support 1. When the shaft 3b is rotated clockwise, the block 3 is turned upward to a position where the block 3 allows the veneer sheet A to move toward the support 1.

The cylinders 4a and 3a are coupled to fluid sources (not shown) which are wired to a controller 23.

A sheet detector 5 is located in proximity to the block 3, and detects the sheet A when the leading end thereof has come to a position directly below the detector 5. The detector 5 is wired to the controller 23, and sends a detection signal thereto upon detection of the sheet A.

A carry roller 6 is located on the left side of the conveyor 2. The carry roller 6 is mounted on a mount 7. The roller mount 7 is coupled to a clutch 7a with a brake. The clutch 7a is in turn connected to an electric motor (not shown) which is wired to the controller 23. The motor is operated to move the roller mount 7 between its two extreme positions. In FIG. 1 the roller mount 7 is in its rightmost position, while its leftmost position is indicated by a broken line of FIG. 1. The roller 6 is coupled to another electric motor (not shown), and is rotated thereby at the same speed as the rollers of the conveyor 2. When the power of the system hereof is turned on, the roller 6 is rotated counterclockwise (in FIG. 1), and as long as the power is on, the roller 6 continues to be rotated in the same direction.

If desired, the conveyor 2 may comprise rows of rollers each consisting of plural rollers which have smaller lengths than the illustrated rollers and with their axes aligned in a direction perpendicular to the sheet conveyance direction, instead of the illustrated rollers each extending along the entire width of the conveyor 2. Likewise, if desired, plural rollers having smaller lengths than the illustrated roller 6 and aligned axially with one another may be used instead of the single roller 6.

Reference numeral 8a designates a detector for detecting the right end of the roller mount 7 when the right end thereof has come from the left side to a position of FIG. 1, that is, a position directly above the detector 8a. By detecting the right end of the roller mount 7, the detector 8a determines that the roller mount 7 has come to its rightmost position. The detector 8a is wired to the controller 23, and sends a detection signal thereto upon detection of the roller mount 7.

Figure 3:
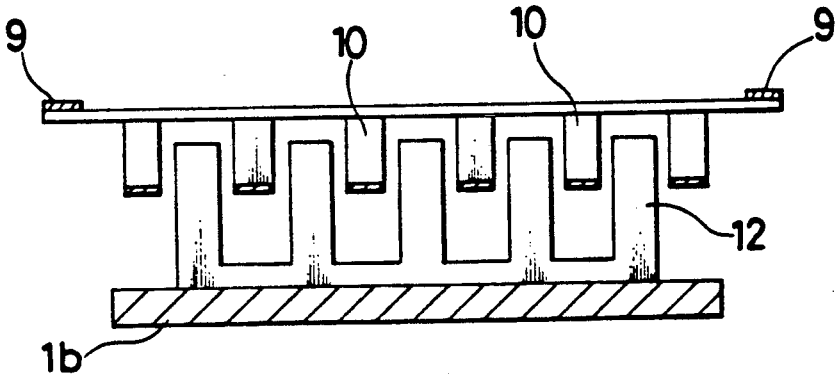
FIG. 3 is an enlarged view which shows a portion of the system of FIG. 1 as viewed from a direction indicated by arrows X and X of FIG. 1.

Reference numeral 9 designates a chain conveyor comprising a pair of parallel chains (FIG. 3) which engage sprockets 9b. The conveyor 9 is coupled to a clutch 9a with a brake. The clutch 9a is in turn connected to an electric motor (not shown) which is wired to the controller 23. The conveyor 9 is operated at a slightly lower speed than the roller conveyor 2. A sheet carrier 10 is fixed to the chains at right angles thereto. The sheet carrier 10 includes a plurality of L-shaped members which are spaced apart from one another along the length of the carrier 10 at predetermined intervals. Each L-shaped member consists of a vertical portion and a horizontal portion 10a which projects therefrom toward the carry roller 6. The horizontal portion 10a has an upper surface which is at substantially the same level as the top of the carry roller 6. The sheet carrier 10 carries the sheet A to a position above the support 1 together with the carry roller 6.

The chains of the conveyor 9 have a distance between them which is greater than the dimensions of veneer sheets B perpendicular to the direction of conveyance thereof so that the sheets B may drop between the chains.

A stopper 12 is fixed to one side of the top of the support 1. As clearly illustrated in FIG. 3, the stopper 12 includes vertical members spaced from one another so as to allow the L-shaped members of the sheet carrier 10 to pass between the vertical members. When the L-shaped members of the carrier 10 go between the vertical members of the stopper 12, the sheet A carried by the carrier 10 and the roller 6 contacts the vertical members and, hence, is stopped from moving further to the left.

Reference numerals 13a, 13b and 13c designate carrier detectors.

The detector 13c detects the right end of the sheet carrier 10 when the right end thereof has come from the left side to a position of FIG. 1, that is, a position directly below the detector 13c. By detecting the right end thereof, the detector 13c determines that the carrier 10 has come to its rightmost position. In FIG. 1 the carrier 10 is in its rightmost position.

The detector 13b detects the left end of the sheet carrier 10 when the left end thereof has come from the right side to a position directly below the detector 13b. At the same time as the left end of the carrier 10 reaches this position, the leading end of the sheet A supported and carried by the carrier 10 and the roller 6 contacts the stopper 12 and, hence, the sheet A is stopped thereby from moving further to the left.

The detector 13a detects the left end of the sheet carrier 10 when the left end thereof has come to a position directly below the detector 13a. By detecting the left end thereof, the detector determines that the carrier 10 has come to its leftmost position indicated by a broken line of FIG. 1. When the carrier 10 has come to its leftmost position, the sheet A is no longer supported by the carrier 10.

The detectors 13*a*, 13*b* and 13*c* are all wired to the controller 23, and send detection signals thereto upon detection of the carrier 10.

The carry roller 6 supported by the mount 7, the chain conveyor 9, the sheet carrier 10, the stopper 12 and the sheet detectors 13*a*, 13*b* and 13*c* are major parts of a mechanism P for carrying the veneer sheet A to the position above the support 1.

Reference numeral 21 designates a belt conveyor. The belt conveyor 21 is coupled to a clutch 21*a* with a brake. The clutch 21*a* is in turn connected to an electric motor (not shown) which is wired to the controller 23. The motor is operated to operate the conveyor 21 intermittently. Two outer veneer sheets B are conveyed by the conveyor 21 in layers.

A chain conveyor 14 is located above the conveyor 9. The conveyor 14 includes a pair of parallel chains which engage sprockets 14*b*. The conveyor 14 is coupled to a clutch 14*a* with a brake. The clutch 14*a* is in turn connected to an electric motor (not shown) which is wired to the controller 23. The chains of the conveyor 14 have a distance between them which is considerably smaller than the distance between the belts of the conveyor 21.

Figure 4:
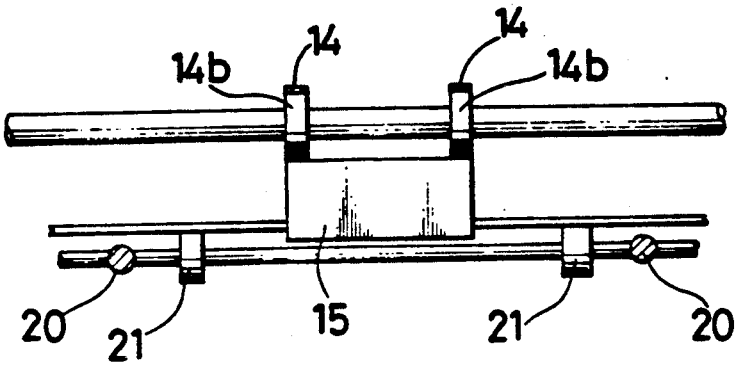
FIG. 4 is an enlarged view which shows a portion of the system of FIG. as viewed from a direction indicated by arrows Y and Y of FIG. 1.

A sheet carrier 15 is fixed to the chains of the conveyor 14 at right angles thereto. The carrier 15 includes horizontal top and bottom portions and a vertical portion which closes the right end of the space between the top and bottom portions. The carrier 15 has a length which is considerably smaller than the distance between the chains of the conveyor 21 (FIG. 4). Also, in the illustrated embodiment, the length of the carrier 15 is substantially equal to a quarter of the dimensions of the veneer sheets B perpendicular to the direction of conveyance thereof. The upper surface of the bottom portion 15*a* of the carrier 15 is at substantially the same level as the tops of the chains of the conveyor 21 such that the bottom portion 15*a* smoothly receives thereon the leading end portions of the veneer sheets B conveyed by the conveyor 21.

The sheet carrier 15 further includes a piston-type cylinder 17 suspended from the top portion thereof. The cylinder 17 has a piston rod with a horizontal press plate 16 at the bottom thereof. The piston rod of the cylinder 17 is operated by air which is supplied under pressure from an air source (not shown). An electromagnetic valve 18 is opened or closed to supply the cylinder 17 with the air from the air source or interrupt the supply thereof. The air source is wired to the controller 23.

When the piston rod is extended, or lowered, the press plate 16 holds the leading end portions of the sheets B to the bottom portion 15*a* of the carrier 15 with a sufficient pressure to move the whole sheets B away from the conveyor 21.

Reference numeral 22 designates a detector for detecting the sheets B when the leading end thereof has come to a position directly below the detector 22. The detector 22 is wired to the controller 23, and sends a detection signal thereto upon detection of the sheets B.

Reference numerals 19*a*, 19*b* and 19*c* designate carrier detectors.

The detector 19*a* detects the left end of the sheet carrier 15 when the left end thereof has come from the right side to a position of FIG. 1, that is, a position directly below the detector 19*a*. By detecting the left end thereof, the detector 19*a* determines that the carrier 15 has come to its leftmost position. In FIG. 1 the carrier 15 is in its leftmost position.

The detector 19*b* detects the right end of the sheet carrier 15 when the right end thereof has come from the left side to a position directly below the detector 19*b*.

The detector 19*c* detects the right end of the sheet carrier 15 when the right end thereof has come from the left side to a position directly below the detector 19*c*. By detecting the right end thereof, the detector 19*c* determines that the carrier 15 has come to its rightmost position indicated by a broken line of FIG. 1.

The detectors 19*a*, 19*b*, 19*c* and 22 are all wired to the controller 23, and send detection signals thereto upon detection of the carrier 15.

Figure 5:
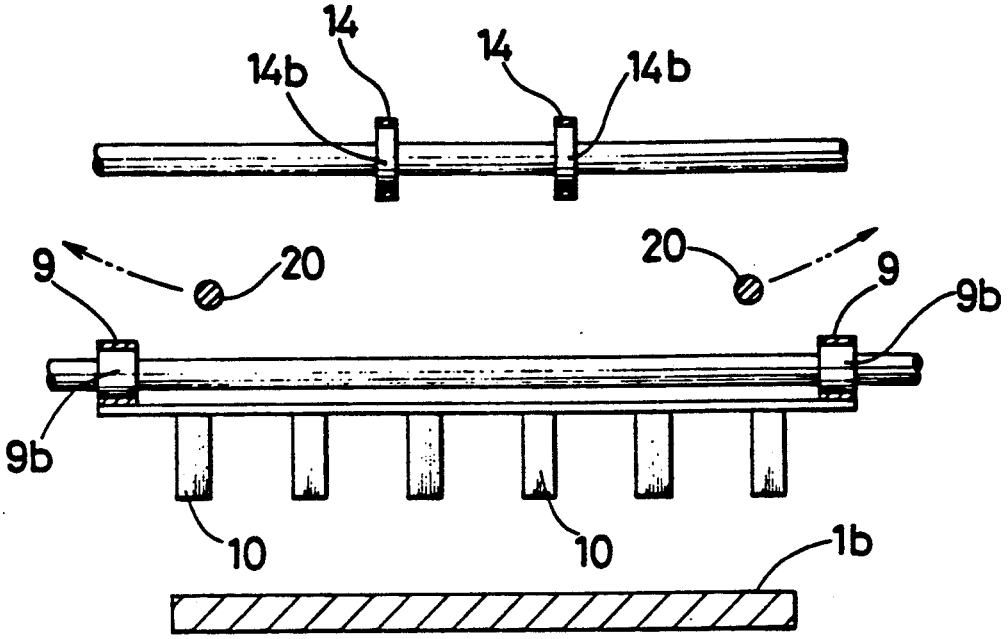
FIG. 5 is an enlarged view which shows a portion of the system of FIG. 1 as viewed from a direction indicated by arrows Z and Z of FIG. 1.

A pair of parallel support bars 20 are located on the right side of the conveyor 21. The support bars 20 extend along the direction of conveyance of the sheets B by the carrier 15, and are spaced apart from each other in a direction perpendicular to the direction of conveyance thereof. The bars 20 are coupled to a piston-type cylinder 20*a*, and are moved thereby between inner positions where the bars 20 support the sheets B conveyed by the carrier 15 from below and outer positions where the bars 20 do not support the sheets B. In FIG. 5 the bars 20 are in the inner, support positions thereof. Arrows of FIG. 5 indicate the outer, nonsupport positions thereof. The cylinder 20*a* is coupled to a fluid source (not shown) which is wired to the controller 23.

The chain conveyor 14, the sheet carrier 15 and the support bars 20 are major parts of a mechanism Q for carrying the sheets B above the sheet A which has been carried to the position above the support 1.

The controller 23 includes delaying circuits (timers).

The operation of stacking of veneer sheets by the foregoing system will now be described. Before veneer sheets from the opposite directions are stacked on the support 1, a single outer veneer sheet B is placed on the support in such a manner that one side of the sheet B engages the stopper 12. Then, when the power of the system is turned on, the roller conveyor 2, the carry roller 6 and the belt conveyor 21 are operated. The block 3 and the press roller 4 are in their positions as shown in FIG. 1. The roller mount 7 and the sheet carriers 10 and 15 are in their starting positions of FIG. 1 which are illustrated by the solid lines. The piston rod of the cylinder 17 is in its retracted position. The support bars 20 are in their inner positions. As mentioned before, as long as the power is on, both the roller conveyor 2 and the carry roller 6 are in operation.

After an adhesive material has been applied to a core veneer sheet A at both the upper and lower surfaces thereof, the core veneer sheet A is placed on the roller conveyor 2 in such a manner that the fibers of the sheet A extend in the direction of conveyance of the sheet A. On the other hand, two outer veneer sheets B are placed on the belt conveyor 21 in layers such that the fibers of the sheets B extend in directions perpendicular to the direction in which to convey the sheets B.

When the leading end of the sheet A conveyed by the conveyor 2 is detected by the detector 5, the block 3 is opened and the press roller 4 is lowered to press the sheet A. The sheet A is thus allowed to move toward the carry roller 6 while the sheet A is being pressed by the press roller 4.

A veneer sheet conveyed by the conveyor 2 may have a portion which is curved in an upward direction. In such a case, unless such a curved portion is flattened, the sheet may turn aside instead of going straight to the carry roller 6. However, the press roller 4 may flatten such a portion by pressing the sheet.

After the lapse of a predetermined slight length of time, i.e., the sufficient time for the leading end portion of the sheet A to ride on the carry roller 6, from the opening of the block 3, the roller mount 7 is moved to the left. The sheet A is thus moved to the left while the sheet A is being supported by both the carry roller 6 and the sheet conveyor 2.

Then, after the lapse of a predetermined slight length of time, i.e., the sufficient time for the leading end portion of the sheet A to ride on the horizontal portions 10*a* of the sheet carrier 10, from the start of the roller mount 7, the chain conveyor 9 is operated to start the sheet carrier 10 to the left. Thus, the sheet A starts to be carried by both the sheet carrier 10 and the carry roller 6.

At the point of time when the sheet A moves further to the left with the leading end thereof supported on the carry roller 6, the sheet A has already been accelerated considerably. Therefore there is no possibility that the leading end portion of the sheet A may incline downward and fail to ride on the horizontal portion 10*a* of the carrier 10. In addition, since the sheet A is conveyed with its fibers extending in the direction of conveyance thereof, such a possibility is completely eliminated.

Figure 6:
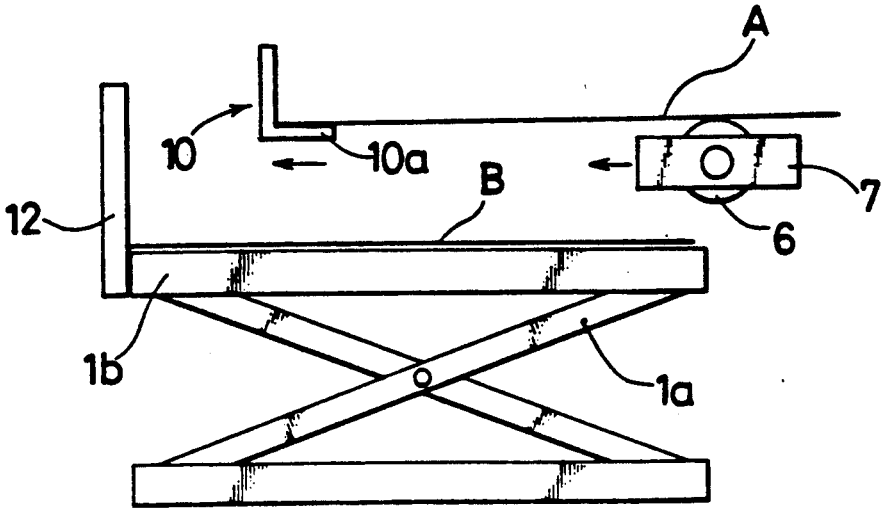
FIGS. 6 to 11 show how veneer sheets are carried to required positions.

After the lapse of a certain length of time from the start of the sheet carrier 10, the sheet A is being carried as shown in FIG. 6. The roller mount 7 does not reach its leftmost position yet. Since the speed of operation of the chain conveyor 9 is slightly smaller than the speed of rotation of the carry roller 6, the leading end of the sheet A is enabled to contact the vertical portions of the sheet carrier 10 during the conveyance thereof by the sheet carrier 10 and the carry roller 6.

Figure 7:
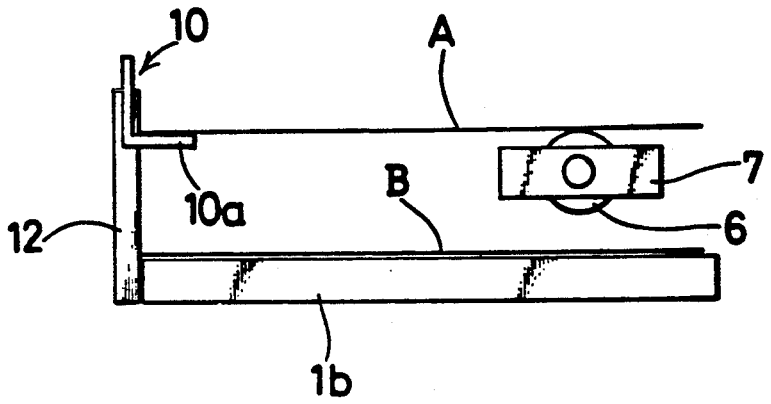
Figure 8:
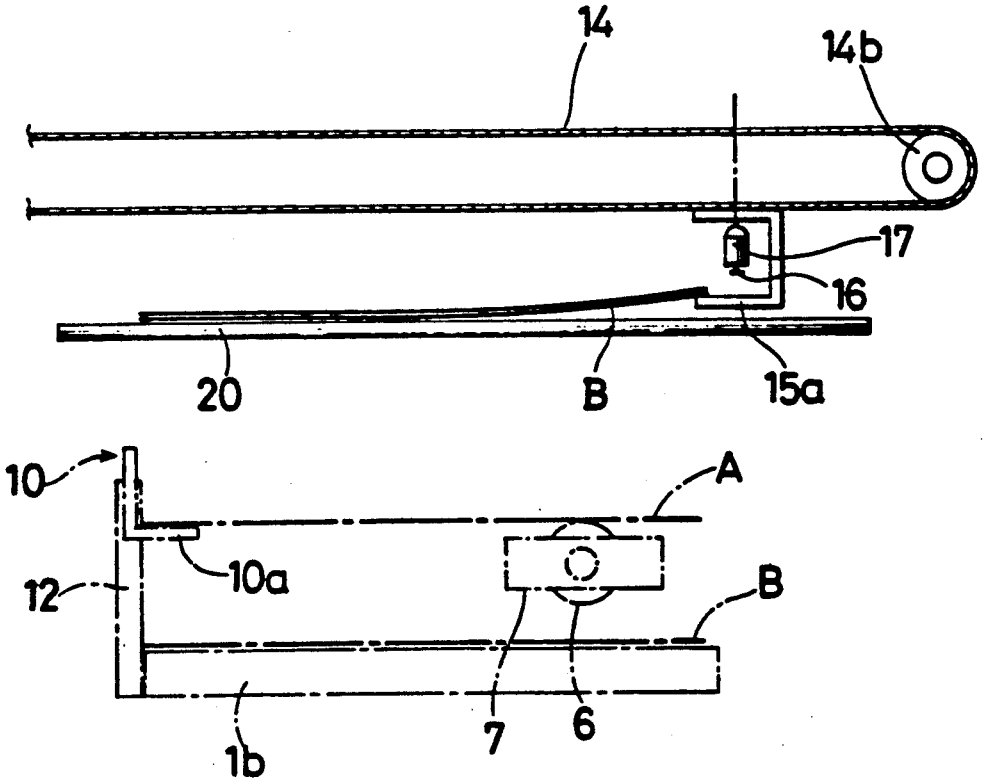

When the left end of the carrier 10 is detected by the detector 13*b*, the conveyor 9 is stopped to stop the carrier 10 with the left end thereof being directly below the detector 13*b* (FIG. 7). The sheet A is thus conveyed continuously up to a position above the support 1 after the placement thereof on the roller conveyor 2. The vertical portions of the carrier 10 are now between the vertical members of the stopper 12, and the leading edge of the sheet A is in contact with the stopper 12. At the same time as the carrier 10 is stopped, the roller mount 7 is stopped. The roller mount 7 is thus now in its leftmost position as indicated by the broken line of FIG. 1 and by the solid line of FIG. 7. Then, the block 3 is closed and the press roller 4 is moved upward.

The sheet A is thus carried to the position above the support 1 as shown in FIG. 7.

On the other hand, as mentioned before, the sheet carrier 15 is in its position as shown by the solid line of FIG. 1, namely, its leftmost position, at the start. When the sheet carrier 15 is in this position, the lower portion of the carrier 15 is between the upper portions of the sheet conveyor 21. The sheets B conveyed by the conveyor 21 come into the sheet carrier 15. And when the leading end of the sheets B is detected by the detector 22, the sheet conveyor 21 is stopped to stop the sheets B. Then, the piston rod of the cylinder 17 is extended. The press plate 16 thus holds the leading end of the sheets B to the horizontal portion 15*a* of the carrier 15. Thereafter, the sheet conveyor 21 is restarted and the upper conveyor 14 is started to move the carrier 15 to the right. The carrier 15 thus carries the sheets B to the right, holding the leading end thereof.

Shortly after the carrier 15 has started, opposed side portions of the sheets B start to be supported from below by the support bars 20.

Figure 9:
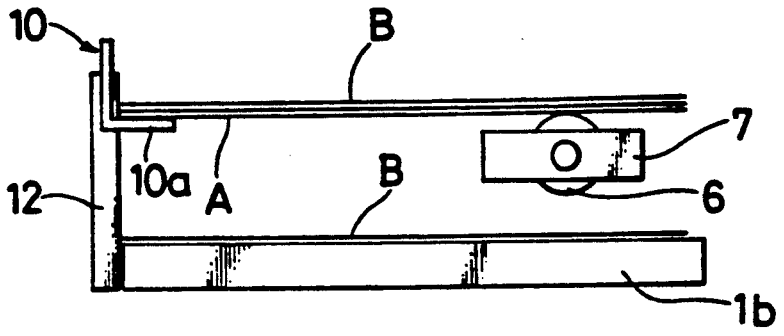

When the right end of the sheet carrier 15 is detected by the detector 19*b*, both the conveyors 14 and 21 are stopped. The trailing edge of the sheets B is now substantially in alignment with the right-hand edge of the stopper 12 and, hence, the left-hand edge of the sheet A in a vertical plane. Then, the piston rod of the cylinder 17 is retracted to disengage the press plate 16 from the sheets B. If at this point of time the carrier 10 for the sheet A is not yet detected by the detector 13*b*, the conveyor 14 is not restarted until the sheet carrier 10 has been detected. However, since the sheet carrier 10 is already detected in this description, the upper conveyor 14 is restarted to move the sheet carrier 15 further to the right. Simultaneously the support bars 20 are moved to their outer positions where the bars 20 no longer support the sheets B. The sheets B thus become unsupported by any means and, hence, drop between the chains of the conveyor 9 on to the sheet A supported by the sheet carrier 10 and the carry roller 6 above the support 1 (FIG. 9).

Figure 10:
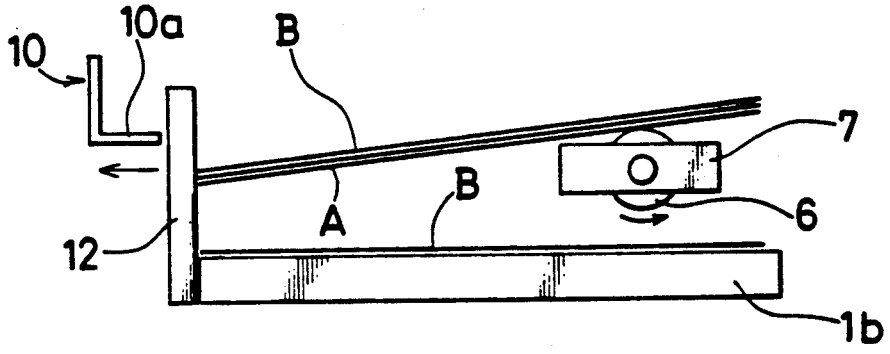
Figure 11:
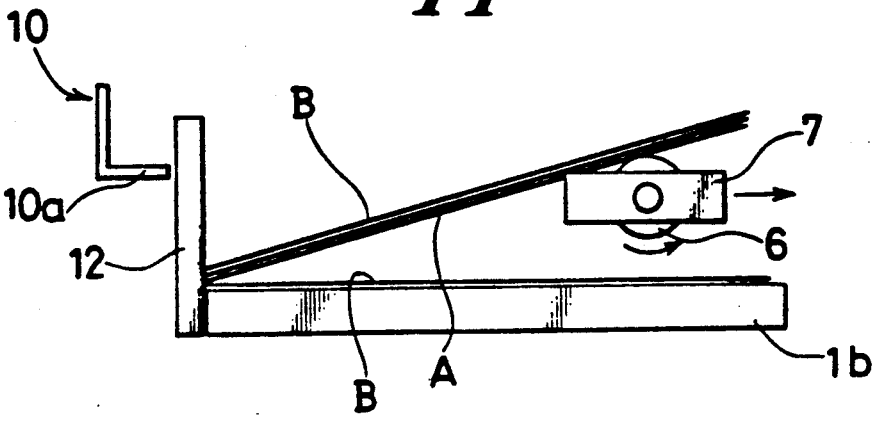

Then, the conveyor 9 is restarted to move the sheet carrier 10 to the left. Thus, the L-shaped members of the sheet carrier 10 pass between the vertical members of the stopper 12 (FIG. 10), but the sheets A and B are not allowed to move with the carrier 10 since the sheets A and B are blocked by the stopper 12. Instead, since the sheets A and B are now no longer supported by the carrier 10, the left end of the sheets drops on the outer veneer sheet B placed on the support 1 prior to the operation of the system (FIGS. 10 and 11). Then, the roller mount 7 is moved back to its rightmost, starting position. Thus the remaining portion of the sheets A and B drop. The sheets A and B conveyed from the different directions are placed on the first sheet B in this way.

Since the carry roller 6 is rotating counterclockwise, there is no possibility that the sheets A and B may move to the right with the roller mount 7 when the roller mount 7 is moved back to the right. In addition, if the rate of movement of the roller mount 7 to the right side is set at a value lower than the rate of rotation of the roller 6, the sheets A and B may be urged against the stopper 12 while moving the roller mount 7 back.

When the sheet carrier 10 reaches its leftmost position indicated by the broken line of FIG. 1, the carrier 10 is detected by the detector 13*a*. Then, the conveyor 9 is stopped and started to be operated in the opposite direction. The sheet carrier 10 thus starts to move back to its rightmost, starting position. When the carrier 10 reaches its starting position, the carrier 10 is detected by the detector 13*c* and is stopped there.

When the roller mount 7 reaches its starting position, the roller mount 7 is detected by the detector 8*a*, and is stopped there.

Shortly after releasing the sheets B, the sheet carrier 15 is detected by the detector 19*c* and is thus stopped in its rightmost position indicated by the broken line of FIG. 1. Then the conveyor 14 is operated in the opposite direction to move the carrier 15 back to its leftmost, starting position. When the carrier 15 is detected by the detector 19*a*, the conveyor 14 is stopped to stop the carrier 15 in its starting position. Then, the support bars 20 are moved to their inner positions, and the sheet conveyor 21 is operated.

All the components are thus moved back to their starting positions.

Then, a subsequent single core veneer sheet and two outer veneer sheets are conveyed from the opposite directions, and are stacked on the preceding sheets on the support 1 in the same manner as described above.

Such a stacking operation may be reiterated a number of times to produce a number of three-layer products.

The three-layer products thus obtained may be provided to a subsequent necessary stage where, for example, the three layers of the veneer sheets are firmly bonded together to finish the products, or sheets of plywood.

Figure 12A:
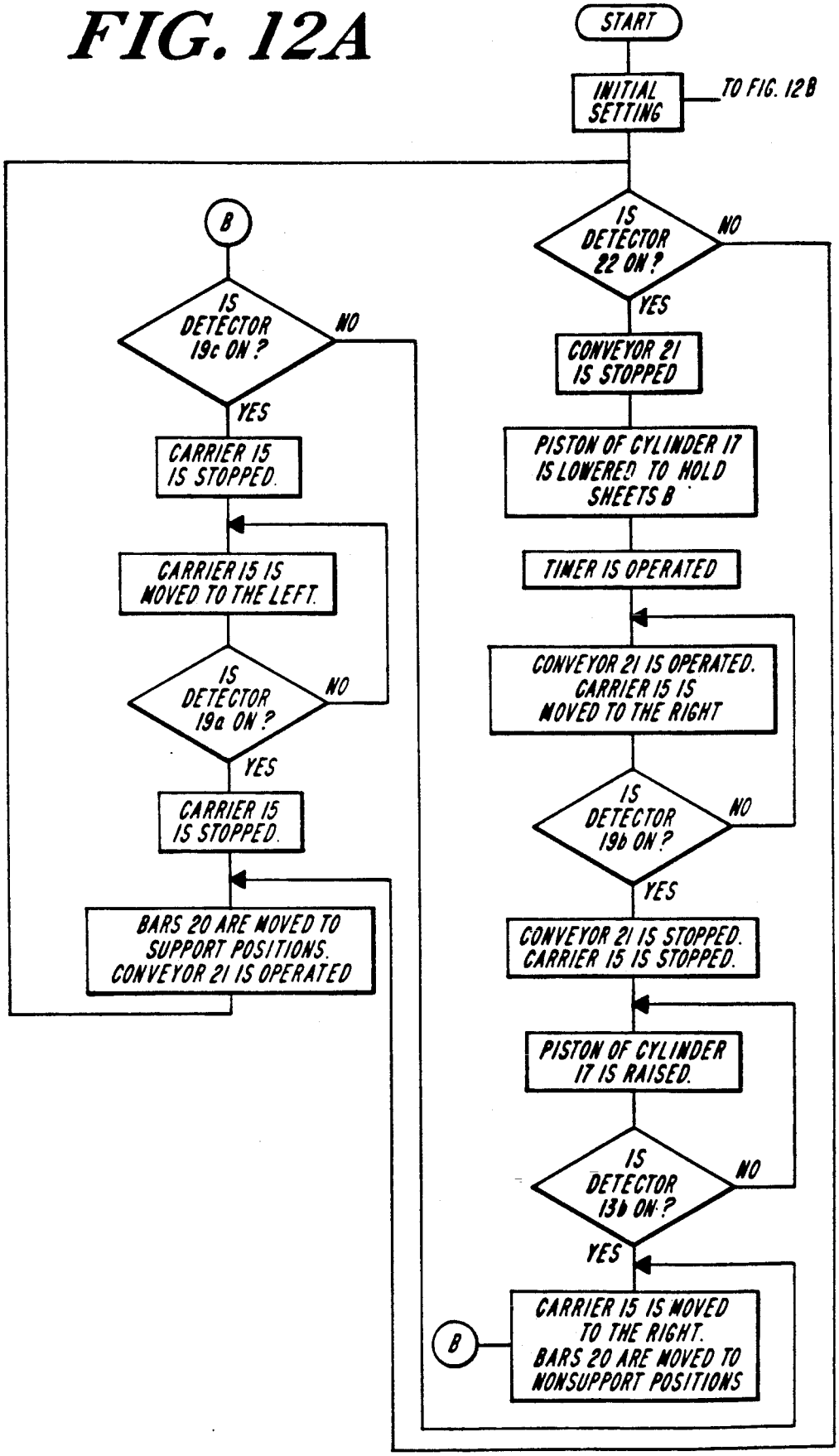
FIGS. 12A, 12B, and 12C show a computer program used for the operation of the system of FIG. 1.
Figure 12B:
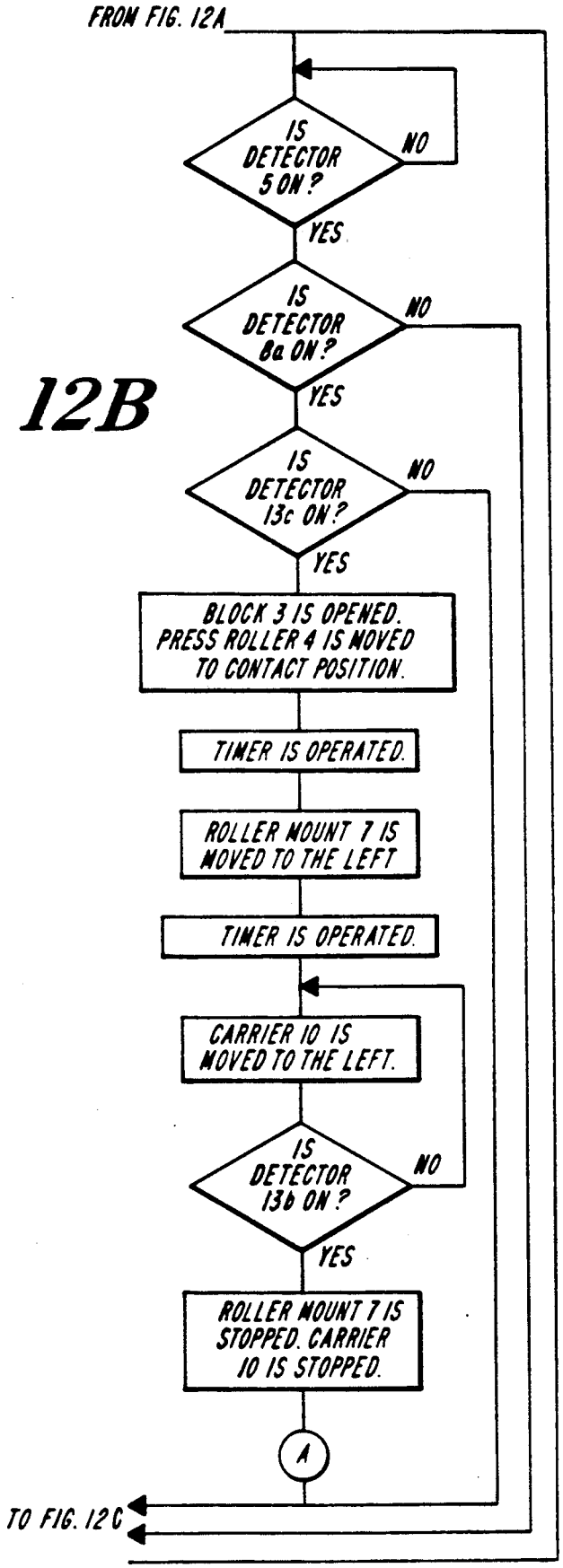
Figure 12C:
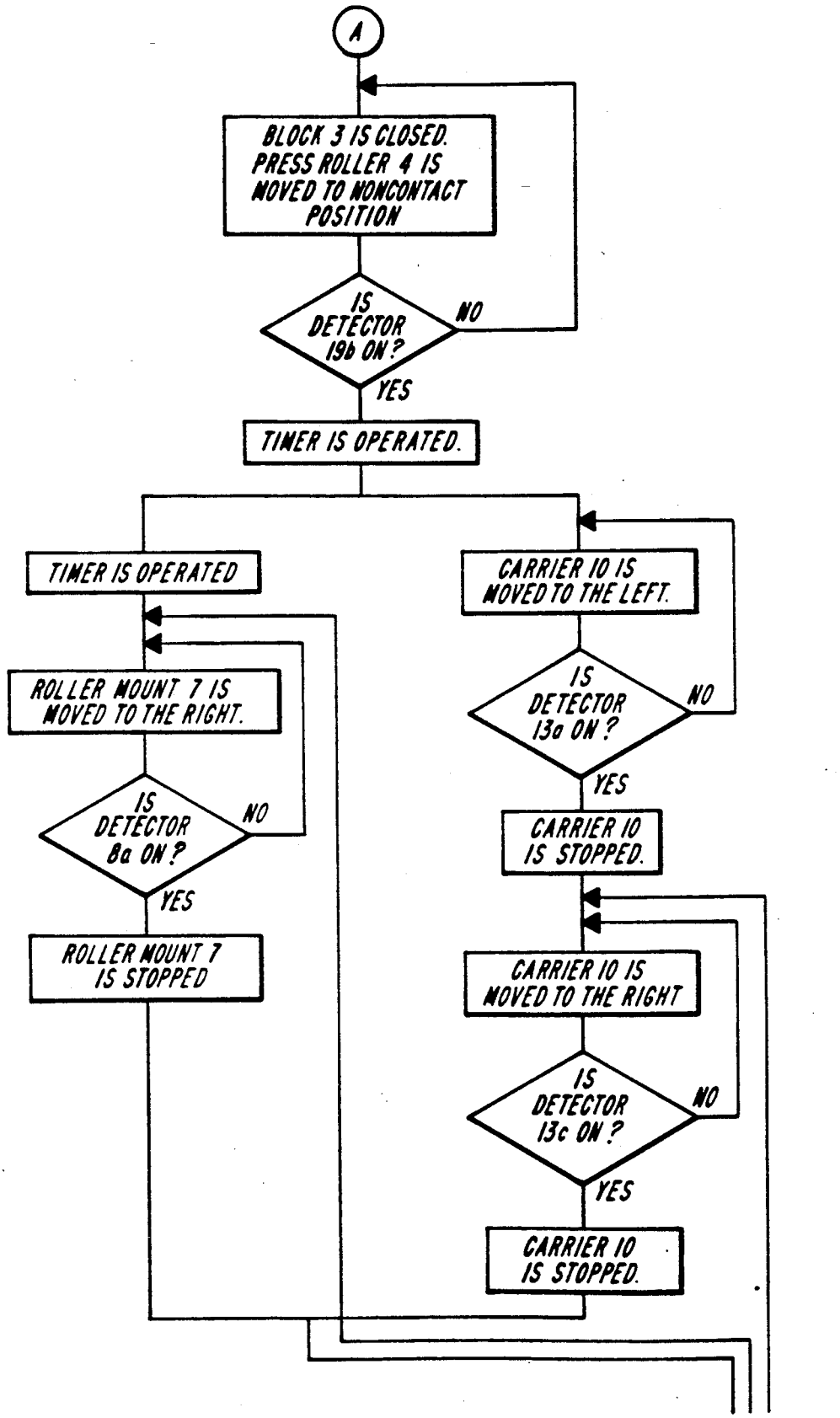
Figure 13:
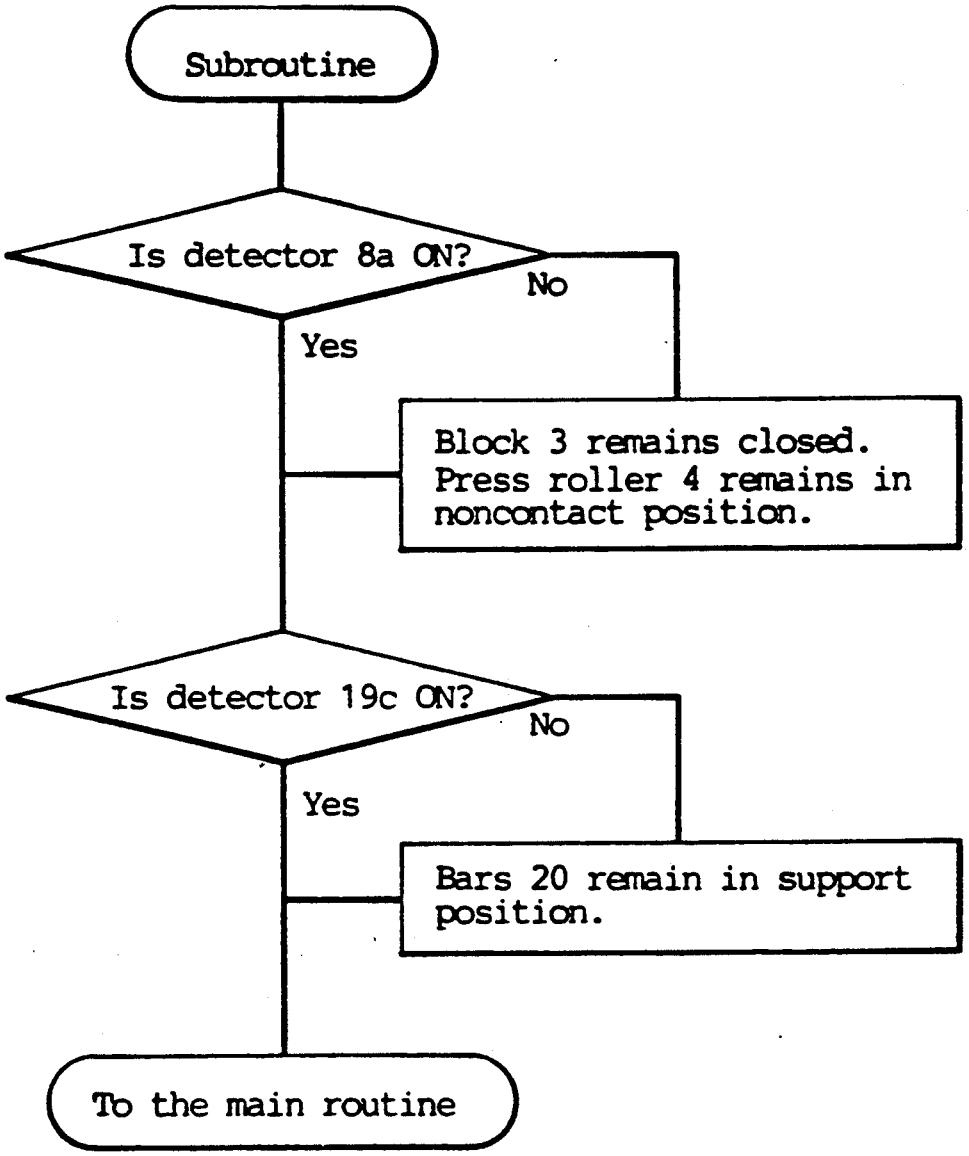
FIG. 13 shows a subroutine used by the computer program of FIGS. 12A, 12B, 12C.

The foregoing stacking operation is performed according to a program of FIG. 12 which includes a subroutine of FIG. 13. The subroutine performs safety functions. That is, according to the subroutine, unless the roller mount 7 is detected by the detector 8*a*, the block 3 remains closed and the press roller 4 remains in its upper, noncontact position. Also, according to the subroutine, unless the sheet carrier 15 is detected by the detector 19*c*, the support bars 20 remains in their inner positions.

According to the foregoing preferred embodiment of the invention, the sheet A carried to the "intermediate" position above the support 1 is not dropped immediately, but waits for the sheets B to be dropped thereon, and then the sheets A and B are dropped from the intermediate position as one body on the support 1. Thus, instead of continuously dropping the much greater distance than the sheet A on the support 1, the sheets B are received by the sheet A on the way down to the support 1. Hence the sheets B are saved from meeting sufficient air resistance to deviate the sheets B from a straight path. In addition, since the sheets A and B join in the intermediate position and thus have an increased weight there, the sheets A and B are dropped more exactly on the predetermined position on the support 1 than if the sheets A and B were dropped separately.

Various Modifications (1) Phototube switches or proximity detectors may be used as the illustrated detectors. However, if desired, pulse oscillators, for example, may be used instead of the illustrated detectors. For example, the motors may be provided with pulse oscillators which emit pulse signals as the conveyor moves, and the pulse signals emitted maybe counted to determine where the object to be detected is. Also, if desired, servomotors may be employed to operate the conveyors, and required information of positions may be stored in the servo-amplifiers to use the servomotors themselves as the required detectors. Moreover, if desired, the illustrated carrier detectors may be omitted, and instead means may be provided for detecting the veneer sheets themselves such that the veneer sheets maybe stopped in the same positions as stopped by detecting the sheet carriers in the illustrated embodiment. For example, the carrier detector 19*b* may be omitted and instead means for detecting the trailing end of the sheets B may be located in a position which is aligned with the right-hand edge of the stopper 12 in a vertical plane.

Figure 14:
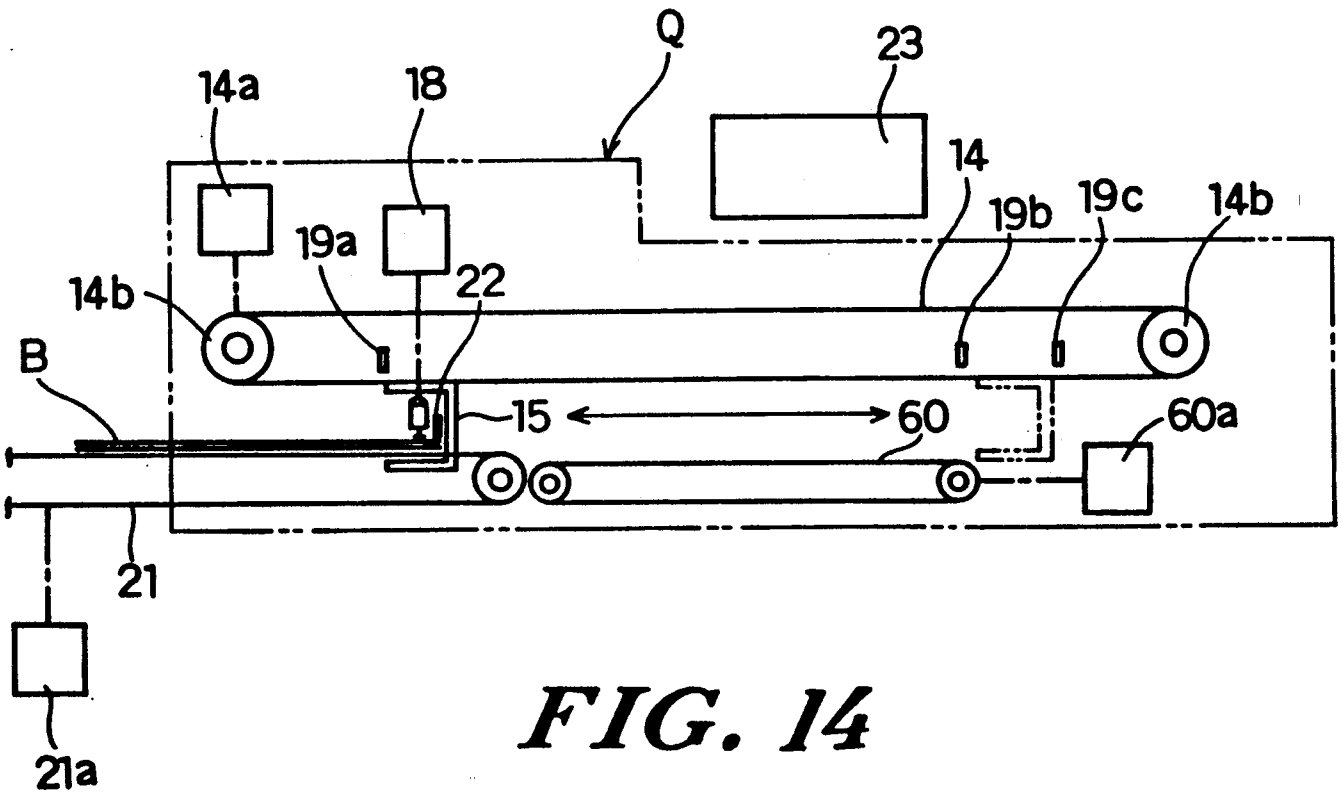
FIG. 14 shows a variation of the stacking system.

(2) If desired, the stacking system hereof may be modified by constructing the carry mechanisms P and Q the other way round. That is, the mechanism P may include means similar to the sheet carrier 15 and the support bars 20 instead of the roller mount 7, the sheet carrier 10 and the stopper 12, while the mechanism Q may include means similar to these components 7, 10 and 12 instead of the sheet carrier 15 and the support bars 20. Also, if desired, the mechanism P may be constructed similarly to the mechanism Q, or vice versa. Moreover, if desired, the support bars 20 may be omitted and instead, as shown in FIG. 14, a belt conveyor 60 including a pair of parallel belts not only rotated, but moved between inner, support positions and outer, nonsupport positions by an operating mechanism 60*a* may be provided in the same position as the illustrated support bars 20. In FIG. 14 the belt conveyor 60 starts to rotate, or make a conveying motion, and stops rotating at the same times as the upper, chain conveyor 14.

Figure 15:
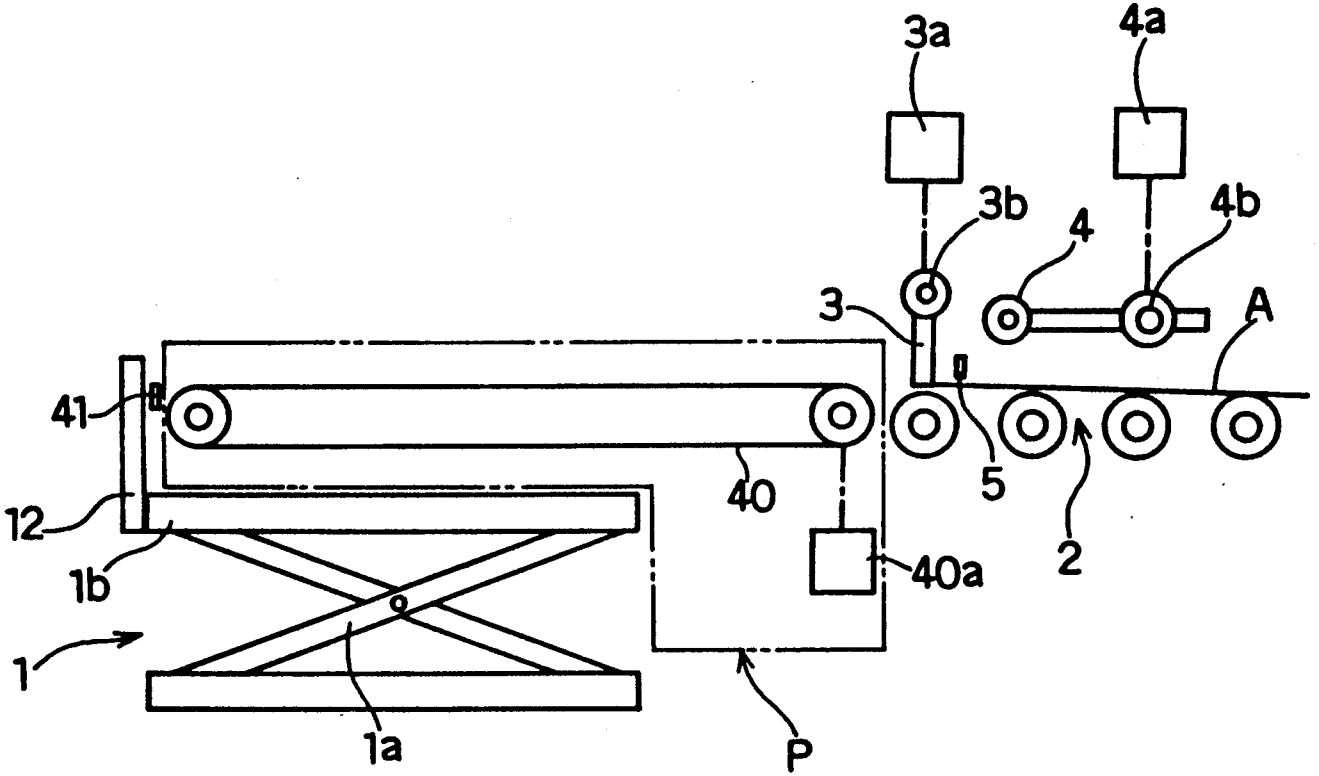
FIG. 15 shows another variation of the stacking system.

Similarly, if desired, the chain conveyor 9, the sheet carrier 10 and the carry roller 6 may be omitted and instead, as shown in FIG. 15, a belt conveyor 40 including a pair of parallel belts not only rotated, but moved between inner, support positions and outer, nonsupport positions by an operating mechanism 40*a* may be provided. In the embodiment of FIG. 15 a detector 41 is also provided which detects the leading edge of the sheet A. In this embodiment the sheet A conveyed by the roller conveyor 2 is transferred on the belt conveyor 40, and is conveyed thereby above the stack support 1. When the leading edge of the sheet A has been detected by the detector 41, the conveying movement (rotation) of the conveyor 40 is stopped. And when the sheet B has been dropped on the sheet A, the belts of the conveyor 40 are moved to the outer positions to drop the sheets A and B on the stack support 1.

Figure 16:
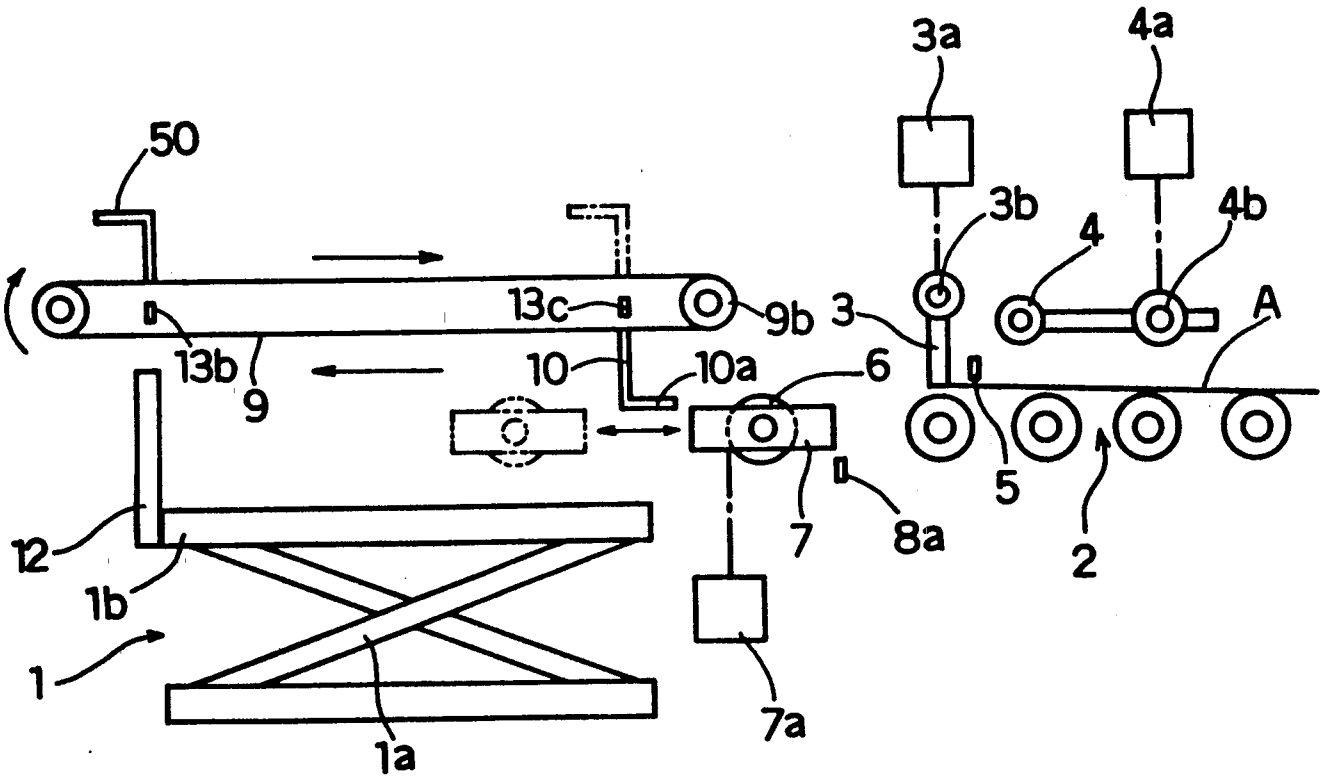
FIG. 16 shows still another variation of the stacking system.

Another modification of the lower sheet-carrying mechanism P is illustrated in FIG. 16. That is, the chain conveyor 9 may be provided with an additional sheet carrier 50 having the same construction as the sheet carrier 10. In this modification the chain conveyor 9 is rotated only in a clockwise direction (in FIG. 16). When the sheet carrier 10 has come to the position directly below a detector 13*c*, the sheet carrier 10 is detected by the detector 13*c* and the chain conveyor 9 is stopped. Then, the sheet A conveyed by the roller conveyor 2 is transferred on the sheet carrier 10 and the carrier roller 6, and is conveyed thereby above the stack support 1. When the sheet carrier 10 has come to the position directly below a detector 13*b*, the sheet carrier 10 is detected by the detector 13*b* and the chain conveyor 9 is stopped. When the sheet carrier 10 is in the position directly below the detector 13*b*, the other sheet carrier 50 is in a position indicated by an imaginary line of FIG. 16. Then, the sheet B is dropped on the sheet A. Then, the chain conveyor 9 is restarted, and the carrier roller 6 is moved back to the starting position. The sheets A and B are thus dropped on the stack support 1. After the lapse of a certain period of time, the sheet carrier 50 comes to the position directly below the detector 13*c*, and is stopped there. There the sheet carrier 50 waits for a next sheet A.

If the lower carry means, namely the sheet carrier 10 and the carry roller 6, is compared with the upper carry means, namely the sheet carrier 15, it may be said that the former is more efficient than the latter since the former is moved to the required position by moving a smaller distance than the latter.

(3) If desired, a pair of upper and lower movable plates may be used, instead of the illustrated sheet carrier 15, to hold and carry the sheets B. Also, if desired, the sheet carrier 15 may be modified to curve the leading end portion in a downward direction immediately before dropping the sheets B (as disclosed in Japanese Patent Application No. 62-229229). If such a modification is made, the entire sheets B may be curved uniformly in a downward direction to drop the sheets B more exactly on the predetermined position. Moreover, the sheets B may be held by means piercing or sucking the sheets instead of the press plate 16.

(4) In the illustrated embodiment the sheet A carried to the intermediate position above the support 1 waits there for the sheets B to be dropped thereon so that the sheets A and B are dropped as one body on the support 1. However, if desired, the system may be so modified that the sheet A starts to be dropped a little earlier than the sheets B come to the intermediate position, and receives the sheets B thereon somewhere between the intermediate position and the support 1 as the sheet A drops. Moreover, it is not impossible to modify so that the sheet A starts to be dropped earlier than the sheets B come to the intermediate position, and receives the sheets B thereon at the same time as the sheet A rests on the support 1 (to be more exact, the sheet B placed thereon at the start), because the sheet A may substantially prevent the sheets B from meeting air resistance by dropping earlier than the sheets B immediately below the sheets B.

In addition, if desired, the outer veneer sheets B may be conveyed by the lower mechanism P and the core veneer sheet A conveyed by the upper mechanism Q.

(5) If desired, the system may be modified to convey the different sheets A and B from perpendicular directions instead of the opposed directions. Also, the system may be modified to convey the sheets A and B manually. Moreover, instead of applying an adhesive material to the sheet A in advance, an adhesive applicator therefore may be located between the roller conveyor 2 and the carry mechanism P.

(6) In the foregoing description the operation of stacking a single core veneer sheet A and two outer veneer sheets B is reiterated to produce a number of three-veneer plywoods. If a number of five-veneer plywoods are to be produced, the operation of stacking a single core veneer sheet A, a single outer veneer sheet B, a single core veneer sheet A and two outer veneer sheets B in the order mentioned is reiterated. For the production of either three-veneer plywoods or five-veneer plywoods, however, a single outer veneer sheet B is placed on the table 1 at the start.

(7) If desired, the same carry mechanism as the upper carry mechanism Q may be additionally provided between the lower carry mechanism P and the table 1. If such an additional carry mechanism is provided, the sheets A and B supported in the intermediate position may be dropped on a sheet or sheets supported on the support bars of the additional lowest carry mechanism, and the support bars thereof may be moved to outer nonsupport positions to drop the three kinds of sheets simultaneously on the table 1.

What is claimed is:

1. A system for stacking veneer sheets conveyed from two different directions to one and the same place, which comprises (a) a stack support on which to stack veneer sheets, (b) a first carry mechanism located above said stack support and including (i) carry means for supporting a first veneer sheet conveyed from a first direction and carrying the first veneer sheet, in a substantially horizontal plane, to a first position directly above a predetermined position on said stack support, and (ii) release means which frees the first veneer sheet from the support thereof by said carry means so as to allow the first veneer sheet to drop from said first position on said predetermined position on said stack support, (c) a second carry mechanism located above said first carry mechanism and including (i) carry means for supporting a second veneer sheet conveyed from a second direction and carrying the second veneer sheet, in a substantially horizontal plane, to a second position above said first position where one edge of the second veneer sheet is substantially in alignment with a corresponding edge of the first veneer sheet carried to said first position in a vertical plane, and (ii) release means which frees the second veneer sheet from the support thereof by said carry means of said second carry mechanism so as to allow the second veneer sheet to drop from said second position on said predetermined position on said stack support, and (d) control means for first operating said release means of said second carry mechanism after the first and second veneer sheets have been carried to said first and second positions, respectively, and then operating said release means of said first carry mechanism after the lapse of a predetermined period of time from the operation of said release means of said second carry mechanism, starting to drop the second veneer sheet earlier than the first veneer sheet such that the first and second veneer sheets together fall forming a stack of enhanced edge alignment on said stack support.

2. A system in accordance with claim 1 wherein said control means operates said release means of said first carry mechanism in such a manner that the first veneer sheet carried to said first position is dropped after the first veneer sheet has received thereon the second veneer sheet dropped from said second position and, hence, the first and second veneer sheets are dropped as one body from said first position.

3. A system in accordance which claim 2 wherein (a) said carry means of said second carry mechanism includes a sheet carrier for carrying the second veneer sheet to said second position while supporting a leading end portion of the second veneer sheet, said sheet carrier being supported for reciprocating motion for a predetermined distance in horizontal directions and a pair of spaced-apart side means for supporting opposed side portions of the second veneer sheet along the direction in which the second veneer sheet is carried, while the second veneer sheet is carried to said second position by said sheet carrier, and (b) said release means of said second carry mechanism includes an actuator for moving said side means between positions where said side means support the second veneer sheet and positions where said side means do not support the second veneer sheet.

4. A system in accordance with claim 1 wherein (A) said carry means of said second carry mechanism includes a sheet carrier for carrying the second veneer sheet to said second position while supporting a leading end portion of the second veneer sheet, said sheet carrier being supported for reciprocating motion for a predetermined distance in horizontal directions and a pair of spaced-apart side means for supporting opposed side portions of the second veneer sheet along the direction in which the second veneer sheet is carried, while the second veneer sheet is carried to said second position by said sheet carrier, and (B) said release means of said second carry mechanism includes an actuator for moving said side means between positions where said side means support the second veneer sheet and positions where said side means do not support the second veneer sheet.

5. A system in accordance with claim 4 wherein said pair of spaced-apart side means comprises a pair of conveyor belts.

6. A system in accordance with claim 1 wherein said carry means of said first carry mechanism comprises a pair of conveyor belts, and said release means of said first carry mechanism comprises means for moving said conveyor belts between inner positions where said conveyor belts support the first veneer sheet and outer positions where said conveyor belts do not support the first veneer sheet.

7. A system in accordance with claim 1 wherein (A) said carry means of said first carry mechanism includes a trailing support which first allows a leading end portion of the first veneer sheet to pass thereon toward said first position and then supports an approximate trailing end portion of the first veneer sheet and carries the first veneer sheet to said first position while supporting said approximate trailing end portion thereof, said trailing support being supported for reciprocating motion for a predetermined distance in horizontal directions and a pair of leading supports which are connected to a conveyor rotatable in one direction only and are spaced apart from each other by a predetermined distance, one of said leading supports receiving said leading end portion of the first veneer sheet from said trailing support and carrying the first veneer sheet to said first position together with said trailing support while supporting said leading end portion of the sheet and the other of said leading supports receiving a next first veneer sheet from said trailing support and carrying the next first veneer sheet to said first position in the same manner as said one of said leading supports after said trailing support has returned to a starting position, and (B) said release means of said first carry mechanism includes a fixed stopper which contacts a leading edge of the first veneer sheet when the first veneer sheet has been carried to said first position and means for moving said leading supports away from said trailing support, after the contact of said stopper and said leading edge of the first veneer sheet, in such a direction that the first veneer sheet becomes unsupported by said leading support.

8. A system in accordance with claim 7 wherein (i) each of said leading supports includes a plurality of L-shaped members spaced apart from one another in a direction perpendicular to the direction in which the first veneer sheet is carried, each of said L-shaped members having a horizontal portion for supporting said leading end portion of the first veneer sheet and a vertical portion, (ii) said stopper being fixed to said stack support and including a plurality of upright members whereby said stopper contact said leading edge of the first veneer sheet, said upright members being spaced apart from one another such that said L-shaped members may pass between said upright members, and (iii) said trailing support includes a roller which is rotated to allow said leading edge of the first veneer sheet to come into contact with said vertical portions of said L-shaped members while the first veneer sheet is being carried to said first position by said trailing and leading supports.

* * * * *